US005265758A

United States Patent [19]

Saint Criq et al.

[11] Patent Number: 5,265,758

[45] Date of Patent: Nov. 30, 1993

[54] STACKED SANITARY PAPER, DISPENSER, AND METHOD FOR MAKING A STACK

[75] Inventors: Jean Saint Criq, Le Chesnay; Henriette Bros, Asnieres, both of France

[73] Assignee: Kaysersberg, S.A., France

[21] Appl. No.: 937,110

[22] Filed: Aug. 31, 1992

Related U.S. Application Data

[62] Division of Ser. No. 465,250, Feb. 16, 1990, Pat. No. 5,143,249.

[30] Foreign Application Priority Data

Jun. 17, 1988 [FR] France ..... 88 08108

[51] Int. Cl.[5] ..... B65H 1/00

[52] U.S. Cl. ..... 221/35; 221/46; 221/119; 221/155

[58] Field of Search ..... 221/34, 35, 45, 46, 221/47, 48, 49, 121, 122, 119, 188, 155, 195, 112, 113

[56] References Cited

U.S. PATENT DOCUMENTS 2,765,909 10/1956 Graham ..... 221/45
3,254,793 6/1966 Palmer ..... 221/155
4,913,312 4/1990 Boutin ..... 221/45

*Primary Examiner*—H. Grant Skaggs
*Attorney, Agent, or Firm*—Breiner & Breiner

[57] ABSTRACT

The present invention concerns a stack of sanitary paper, a dispenser and a manufacturing method for the stack. The stack of sanitary paper consists of folded, interleaving sheets forming a pile which is placed inside a cardboard sleeve (1) which is open at both ends and characterized in that the sleeve (1) comprises a first pair of opposite sides (14, 15) parallel and adjacent to the folding edges of the sheets, a second pair of sides (12, 13) parallel to the sheet surfaces and perpendicular to the first pair, and an opening (10) in at least on one of the sides of the second pair (12, 13).

3 Claims, 2 Drawing Sheets

FIG. 3
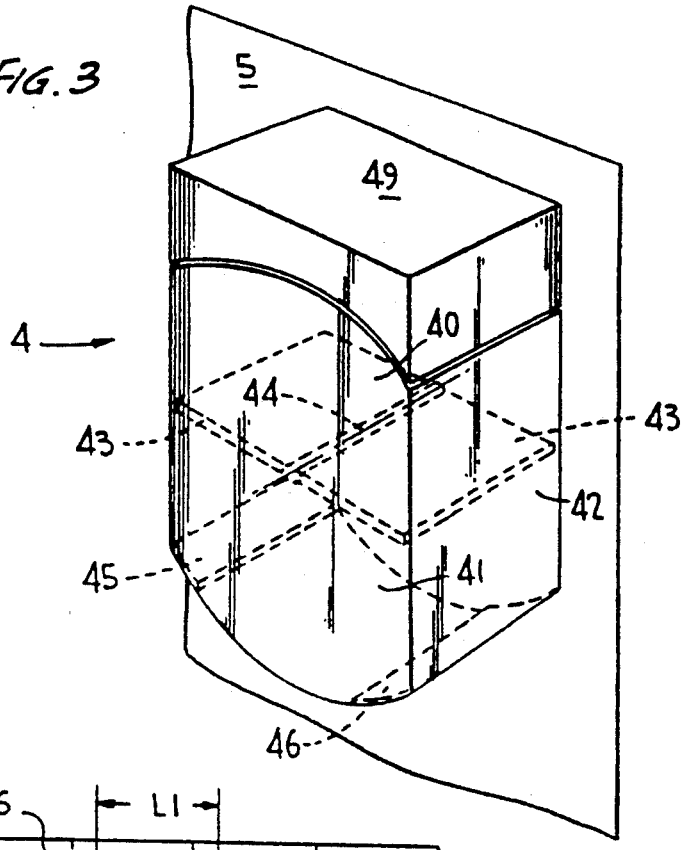
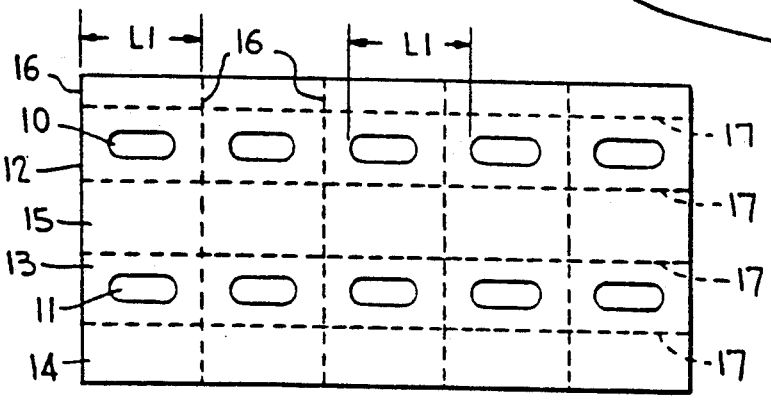
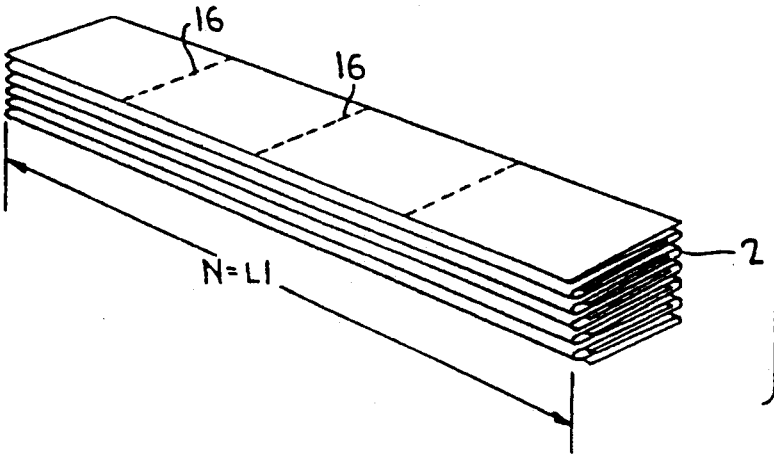
FIG. 4

STACKED SANITARY PAPER, DISPENSER, AND METHOD FOR MAKING A STACK

This is a division of application Ser. No. 07/465,250 filed on Feb. 16, 1990, now U.S. Pat. No. 5,143,249 issued Sep. 1, 1992.

The present invention concerns a stack of sanitary papers, their dispenser and the method for manufacturing the stack.

Stacks of interleaved sheets of sanitary paper offer a number of advantages over paper on a roll. Dispensing sheet by sheet is more economical than a roll with precut surfaces which rotates by itself and, hence, is susceptible to being turned and several sheets being taken off. Again, at constant volume, the product density in a stack of sheets is higher than for a roll because of the lack of a spindle.

In view of such economy and compactness, sanitary paper in sheet form is ideally suited, especially where many people are present.

The sheet products of the prior art offer the advantage of improved sanitation as compared to rolls, because in shipping each stack is protected whereas a roll is not. However, these sheet stacks of the prior art entail the drawback as regarding groups of people in that the sheet stacks require handling to be put into dispensers. Such handling causes waste. Further, when coming to the end of use of a loaded dispenser, the last sheets tend to drop out, causing additional waste.

Accordingly, a first object of the invention is to provide a stack of sanitary sheets folded so as to be interleaving, making it possible to avoid waste and assuring easy implementation, in particular where a large group of people are involved.

This problem is solved by a stack of sanitary paper consisting of sheets so folded as to be interleaving and forming a pile inside a cardboard sleeve which is open at both ends, and being characterized in that the sleeve comprises a first pair of opposite sides which are parallel and adjacent to the sheet folds, a second pair of sides which are parallel to the sheet surfaces and perpendicular to the first pair, and an opening in at least one of the sides of the second pair.

In an additional feature, the stack comprises a second opening in the second side of the second pair.

In another feature, the openings are oval.

In another feature, the openings are circular.

Another object of the invention is a dispenser for the above stacks.

Regarding that object of the invention, the stack dispenser comprises a right-parallelipiped envelope of which the height corresponds to N superposed stacks and the base of which corresponds to the area of a folded sheet, and two narrow side supports adjacent to vertical, opposite sides of the envelope so as to subtend an opening larger than that of the sleeves.

In another feature of the invention, the dispenser includes a transparent door on that side opposite the envelope fastening side to make visible the filling level of the sleeve.

In another embodiment, the dispenser comprises a hollow envelope shaped to receive a stack of papers on either side of a plane of symmetry through which a pivot shaft passes, the sides opposite to the plane through which passes the pivot shaft about a fixed part of the dispenser being equipped with side supports defining a larger opening than that of the sleeve but less than the stack size; and further, aligned with the envelope of which the opening is not in the dispensing position, a seal for the opening solidly joined to the stationary dispenser part.

In an additional feature, one of the envelope sides, which is located in a plane parallel to the pivot shaft and is on the same side of this shaft, is provided with a transparent door.

Lastly, an object of the present invention is a method for manufacturing stacks of sanitary paper consisting of folded, interleaving sheets which allow for the economical use of these stacks.

This object is achieved in that the manufacturing method of stacks of sanitary sheets which are folded in an interleaving manner comprises the following stages:

cutting at least one row of apertures, at equidistant spaces, matching the width of a stack and in a direction parallel to a folding generatrix into a wide cardboard strip, stacking strips of the wide, interleaving paper sheets, folding along the generatrices and winding a cardboard strip around the stack of sheets to create a tube with a parallelipipedic cross-section, cutting the tube in a direction perpendicular to the tube generatrix midway the distance between the adjacent edges of the two openings.

Other features and advantages of the present invention shall be elucidated in the description below in relation to the attached drawings.

FIG. 3 is a second embodiment of a stack dispenser of the invention, FIG. 4 shows the elements with which to implement the stack manufacturing method of the invention.

Figure 1:
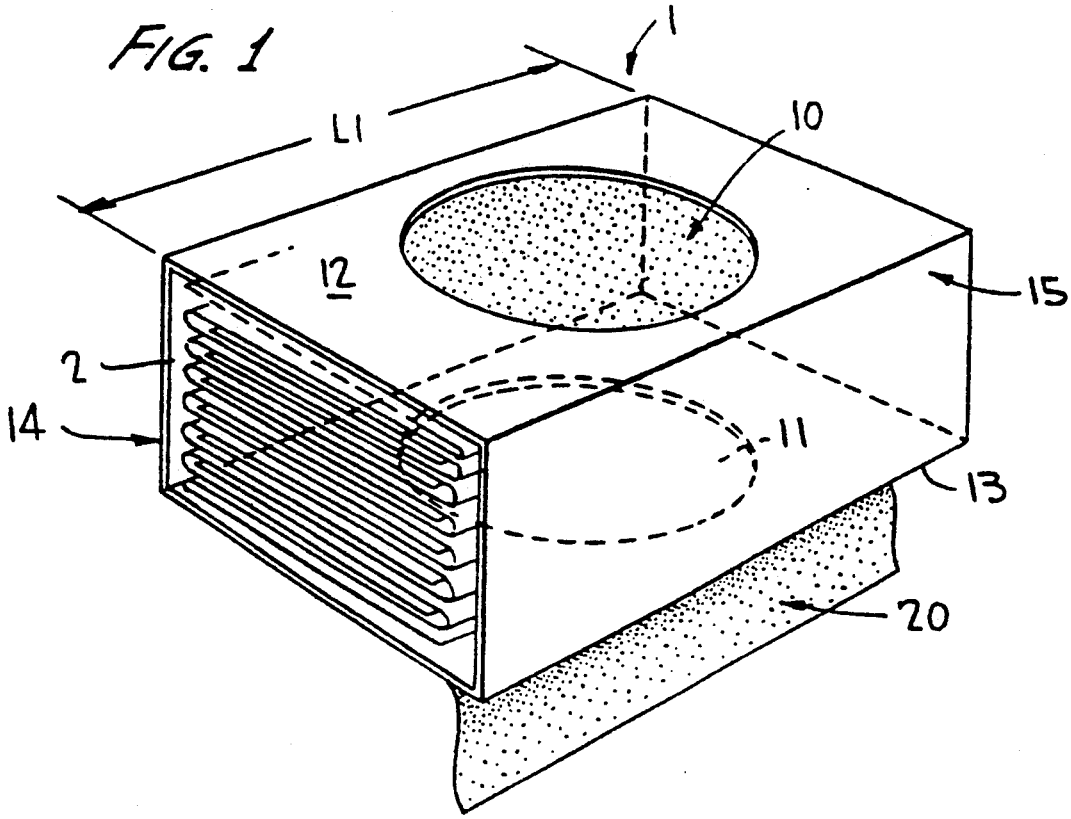
FIG. 1 is a perspective side view of the stack of the invention.

The stack of sanitary paper of the invention comprises a cardboard sleeve consisting of a cylinder of parallelipipedic cross-section having one opening each, 10, 11, in the two opposite surfaces, 12, 13, respectively, of the cylinder presenting the largest surfaces. A stack 2 of sanitary paper is inside the cylinder. In a manner known per se, this stack 2 consists of interleaved sheets folded at half surface so that the folding edges are located at the opposite stack sides corresponding to the cylinder sides 14, 15 which are perpendicular to the first two sides 12, 13.

The openings in the sleeve surfaces 12, 13 opposite the main sheet surfaces allow dispensing of the sheets one at a time. Accordingly, sheet 20 may be pulled by the user and its withdrawal shall drag along the next interleaved sheet. The stack 2 of absorbent sheets in the sleeve 1 may be compressed during manufacture and kept compressed by the sleeve so as to increase each stack's contents. Moreover, as the paper is being gradually used up, this arrangement allows for keeping some pressure on the stack of sheets to avoid the dispensing of several sheets at one time. The shape of openings 10, 11 may be oval, circular, or any other shape which allows sheet dispensing in the absence of waste.

Figure 2:
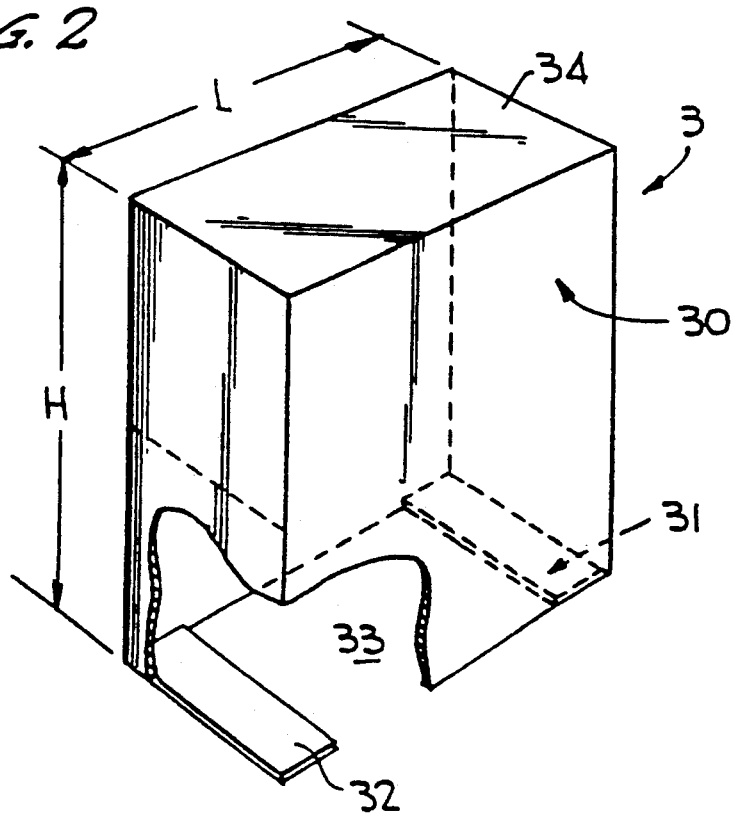
FIG. 2 is a first embodiment of the dispenser for the stacked, interleaved sanitary paper of the invention.

The above-described stack is used in a dispenser of a first embodiment which is schematically shown in FIG. 2. This dispenser 3 consists of a parallelipipedic box fastened by one of its ends to a wall. Illustratively, the side opposite that fastened to the wall consists of a transparent door 30 partly extending to the adjacent edges. The height H of this box corresponds to two stack thicknesses, and the upper surface 34 of the box is slightly larger than the corresponding stack surface 12. The side opposite the upper surface 34 comprises an opening 33, which illustratively is about 80% of the surface. This opening is bounded by two side supports 31, 32 which keep the stacks in place without hampering access to the opening 11, thereby allowing sheet dispensing.

Each of the side supports 31, 32 will correspond its width to that of the width L of the box, for instance being 10% of width L. The opening 33 may amount to 40% to 80% of the area corresponding to the base area 34, and the side supports shall match the width L of the box by about 30% to 10% of that width.

Such a dispenser combined with a stack of the invention offers the advantage of making it easy to reload. There is no need to remove the sleeve and to handle, sometimes with great difficulty, the stack of sheets in order to reload the dispenser. The absence of handling also contributes to hygiene since the sheets, including to the last sheet, remain protected in the sleeve. Moreover, conventional sheet dispensers comprise a narrow slit over the entire dispenser width matching the sheet width which, at the end of use, allows premature sheet dropping to take place.

As regards the invention, openings 10, 11 are limited relative to the width L1 of a stack, thereby averting sheets dropping by themselves through the dispenser slit at the end of use. The transparent door displays the filling level of the dispenser. At the end of use of a sleeve, this sleeve may be moved through the very wide opening 33 at the bottom of the dispenser so as to put in place the second stack.

FIG. 3 shows a second embodiment of a dispenser 4 comprising two hollow envelopes 40, 41 joined by a plane 43 through which passes a pivot shaft 44. This pivot shaft 44 allows the hollow envelopes 40, 41 to rotate relative to a stationary part 5 of the dispenser. The two hollow envelopes 40, 41 are open at the ends opposite the junction plane 43, and each are provided with two side supports 45, 46 and 47, 48, with the latter pair not being visible in the drawing. A cap 49, which is rigidly joined to the stationary part 5, closes the open surface of the enclosure 40 which will be in the upper position when the lower enclosure 41 is in the lower position to dispense paper.

When the paper of the stack in enclosure 41 is exhausted, the dispenser is made to rotate about the shaft 44 so that the enclosure 40 will be moved to the lower position. Following this motion, the opening between the side supports 45, 46 will be opposite the cap 49. At least one of the dispenser faces, for instance a lateral one, will consist of a transparent door 42 so the filling level of the dispenser may be noted.

The method for manufacturing the stacks of FIG. 1 will now be discussed in relation to FIG. 4.

This figure shows a stack 2 of absorbent sheets having a length corresponding to N stacks. A row of openings 10, spaced apart by a distance L1, is cut into a cardboard strip having a width which matches N stacks with dimension L1. Optionally, a second row of spaced openings 11, of the same size and arranged opposite the first row, may be cut out so that the openings will be located on the opposite sides of the stack of sheets when constructed. Next, following folding of the cardboard sheet along the folding lines 17, this cardboard is wound around the sheet stack 2 to form a sleeve. The sleeve is formed by stapling, or the like, the strip 16, which will be superposed on part of the surface 14. The last step in the manufacture of the stacks is the cutting along the lines 16 to provide a set of stacked sheets enveloped by a sleeve.

Other modifications being within the ability of one skilled in the art are covered by this invention. Illustratively, the sleeves may comprise a single opening on a single side.

We claim:

1. A dispenser for at least one stack of sanitary papers having folded interleaved sheets constituting a pile positioned inside a sleeve open at both ends, wherein said sleeve comprises a first pair of opposite side walls which are parallel and adjacent to said sheets' folded edges, a second pair of side walls which are parallel to said sheets' surface and perpendicular to said first pair of side walls, and an opening in at least one of said side walls of said second pair of side walls, comprising two hollow envelopes wherein each of said two hollow envelopes has a shape capable of receiving at least one stack of said sanitary papers and wherein said two hollow envelopes are joined by a plane through which a pivot shaft passes, a first and second side wall with one side wall each being positioned opposite said plane through which said pivot shaft passes, each of said first and second side walls being made up of a pair of supports positioned so as to define an opening larger than said sleeve opening of said stack but less than said surface of said stack, and a means of sealing either of said openings in said side walls when said means is in alignment with one of said first or second side walls in one of said two hollow envelopes when one of said side walls is in a non-dispensing position.

2. A dispenser according to claim 1 wherein said at least one stack of sanitary papers has in each of said side walls of said second pair of side walls an opening therein.

3. A dispenser according to claim 1 wherein each envelope of said two hollow envelopes contains a transparent door on one side of said envelope in a plane parallel to said pivot shaft.

* * * * *